United States Patent [19]

McKann

[11] 4,453,752

[45] Jun. 12, 1984

[54] ADAPTER ASSEMBLY FOR DEADBOLT PREPARATION

[75] Inventor: H. Smith McKann, Fredericksburg, Va.

[73] Assignee: General Products Company, Incorporated, Fredericksburg, Va.

[21] Appl. No.: 371,953

[22] Filed: Apr. 26, 1982

[51] Int. Cl.[3] ..... E05R 15/02

[52] U.S. Cl. ..... 292/341.19; 292/341; 292/341.14

[58] Field of Search ..... 292/341.19, 341, 341.18, 292/244, 341.12, 341.14, 340; 70/450

[56] References Cited

U.S. PATENT DOCUMENTS

| | | | |
|---|---|---|---|
| 1,059,530 | 4/1913 | Dupuis | 292/341.19 |
| 1,093,816 | 4/1914 | Wiley | 292/341.19 |
| 1,238,924 | 9/1917 | Kennedy | 292/341.19 |
| 2,013,145 | 9/1935 | Goetz | 292/341.18 |
| 3,039,291 | 6/1962 | Dusing et al. | 70/451 |
| 3,265,427 | 8/1966 | Williams | 292/341.18 |
| 3,364,624 | 1/1968 | Davis | 49/505 |
| 3,401,487 | 9/1968 | Brandt et al. | 49/504 |
| 4,065,163 | 12/1977 | Nagase | 292/244 X |
| 4,080,813 | 3/1978 | McKann | 70/450 |
| 4,213,317 | 7/1980 | Ruff | 70/450 |

FOREIGN PATENT DOCUMENTS

| | | | |
|---|---|---|---|
| 10845 | 12/1927 | Australia | 292/341.18 |
| 425466 | 12/1923 | Fed. Rep. of Germany | 292/341.19 |

*Primary Examiner*—Gary L. Smith
*Assistant Examiner*—R. Illich
*Attorney, Agent, or Firm*—Roylance, Abrams, Berdo & Goodman

[57] ABSTRACT

An adapter assembly is used in combination with a door of the type having an elongated opening to receive a bolt extending from a lock which is mounted in a door coupled to the frame. The adapter assembly comprises an elongated strike plate, mounting means for coupling the strike plate to the frame in one of two inverted positions and an adjustable cover. The strike plate has an elongated, generally rectangular aperture longitudinally offset toward one end of the strike plate. The adjustable cover is coupled to the strike plate for closing at least a portion of the strike plate aperture and the opening in the door frame. This provides a simple mechanism for customizing the opening in the door frame to any one of a wide variety of different lock and knobset arrangements by varying the size and location of the opening.

10 Claims, 11 Drawing Figures

12
14
18
20
26
30
52
54
56
58

ADAPTER ASSEMBLY FOR DEADBOLT PREPARATION

This invention relates to an adapter assembly for preparing a door frame to properly receive the bolt of a lock mounted in a door coupled to the door frame. More particularly, the adapter assembly is adjustable to customize the door frame to a plurality of different lock types.

BACKGROUND OF THE INVENTION

It is common practice at this time to provide a door, particularly a door which is provided as an "outside" door for a dwelling or other space, with a knobset which may or may not have a lock therein, and a separate lock of the "deadbolt" type. The term "outside" as thus used is intended to mean the primary access to a space and can include the main entrance to an apartment or office within a larger structure. Solid wooden doors and frames therefor are commonly manufactured with no lock openings such that the carpenter or locksmith installing the lock assembly cuts the necessary openings.

For metal door frames it is more difficult to accurately and neatly locate and cut the necessary openings in the frame to receive the bolt or bolts of the lock or locks in the door at the point of installation using conventional hand tools. For this reason, it is desirable to provide such openings at the time of manufacture.

The door and door frame manufacturer usually does not know the specific type of lock which will ultimately be installed in the door and door frame. Deadbolt locks produced by different manufacturers have various physical configurations and can be spaced at various locations along the door edge. For example, the deadbolt lock can be installed independently of a standard knobset with a lock incorporated therein. Alternatively, a combination unit can be installed including the knob assembly with a lock incorporated therein and a separately lockable deadbolt as part of the same assembly. Since these combination units made by different manufacturers are not standardized, the vertical spacing between the knobset center line and the deadbolt center line varies. Thus, the door frame manufacturer does not know the exact size and location of the rectangular opening for the bolt of the deadbolt lock along the length of the door frame. The same problem exists for independently mounted deadbolt lock and knobset devices.

Thus, a need has developed for a system to adapt the opening in a door frame for the deadbolt lock such that the frame can conform to a wide variety of lock styles.

BRIEF DESCRIPTION OF THE INVENTION

It is therefore an object of the present invention to provide a deadbolt preparation adapter assembly which can be easily modified at the time of lock installation to customize the opening in the door frame for the deadbolt lock as to location and size.

Another object of the present invention is to provide an adapter assembly for forming and locating a deadbolt lock opening in a door frame which is of rugged construction and which is simple and inexpensive to manufacture and install.

Briefly described, the invention includes an adapter assembly for use in combination with a door frame of the type having an elongated opening to receive a bolt extending from a lock mounted in a door coupled to the frame. The adapter assembly comprises an elongated strike plate, means for coupling the strike plate to the door frame and adjustable cover means. The elongated strike plate has an elongated, generally rectangular aperture therein which is longitudinally offset toward one end of the strike plate. The mounting means permits the strike plate to be coupled in either of two relatively inverted positions. The cover means is coupled to the strike plate such that it closes at least a portion of the aperture and the opening.

In this manner, the door frame manufacturer can form the elongated opening in the frame along that portion of the frame necessary to receive the vast majority of combined and separate knobset and deadbolt lock assemblies presently on the market. With such opening formed in the door frame, the opening can be adapted in size and location along the length of the door frame by (1) attaching the strike plate in one of its two relatively inverted positions to variably locate the strike plate aperture, and then (2) forming and couplng the cover means to the plate to close the portion or portions of the strike plate aperture and exposed door frame opening not necessary for receiving the deadbolt lock. This provides a simple and efficient system for customizing the aperture for the deadbolt lock at the proper vertical position from the threshold and from the knobset bolt, and of the proper size.

The aperture in the strike plate can have a length approximately one-half that of the strike plate. This permits the remaining half of the strike plate to cover portions of the frame opening which are not necessary to receive the lock bolt. With the aperture completely surrounded by the plate, the plate is more rigid and the portions of the plate laterally adjacent the aperture facilitate coupling of the cover means.

The cover means can comprise an elongated cover plate having flanges extending along opposite lateral side edges thereof and an elongated central protrusion extending parallel to and between the flanges. The flanges are trapped between the strike plate and the door frame and are frictionally engaged therewith such that the position of the cover plate is infinitely variable along the length of the strike plate aperture. The central protrusion extends through the strike plate aperture to provide a flush finish for the covered portions of the frame opening. Additionally, weakened zones along lines extending transversely across the cover plate can define a plurality of severable cover portions, any combination of which can be coupled to the strike plate at selected locations along the aperture. These cover plate portions enhance the adaptability of the system to permit formation of a wide variety of strike plate aperture sizes and locations.

BRIEF DESCRIPTION OF THE DRAWINGS

In order that the manner in which the foregoing and other objects are obtained in accordance with the invention can be understood in detail, reference is made to the accompanying drawings which form a part of the specification and wherein.

DETAILED DESCRIPTION OF THE PREFERRED EMBODIMENT OF THE INVENTION

Figure 1:
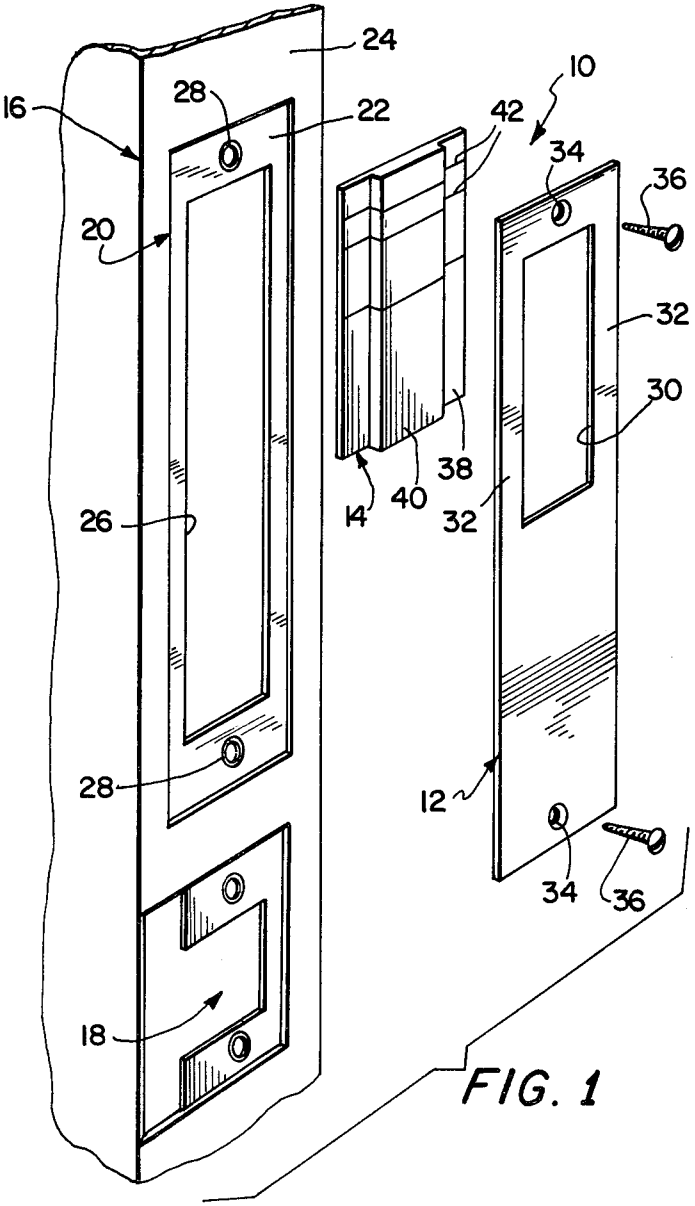
FIG. 1 is a fragmentary perspective exploded view of a portion of a door frame with an adapter assembly according to the present invention.

Referring initially to FIG. 1, the adapter assembly 10 of the present invention comprises a strike plate 12 and a cover plate 14. The adapter assembly is particularly intended for use in combination with a door frame 16 of the type having a knobset lock bolt preparation 18 and a deadbolt receiving preparation 20 located above the knobset preparation. The knobset preparation is of conventional design, and thus, is not described in detail.

The deadbolt receiving preparation comprises a mounting flange 22 which is recessed from the exposed face 24 of the door frame. An elongated rectangular opening 26 is centrally located in mounting flange 22. The size and location of opening 26 is selected by the door frame manufacturer relative to the center line of knobset preparation 18 and the threshold for the door frame such that opening 26 can receive a wide variety of deadbolt lock styles. Typically, door frame opening 26 is 4.44 inches long, is 0.875 inch wide and has a center line spaced 4.4375 inches above the center line of knobset preparation 18. Mounting holes 28 are formed in mounting flange 22 adjacent the upper and lower ends of opening 26.

Figure 2:
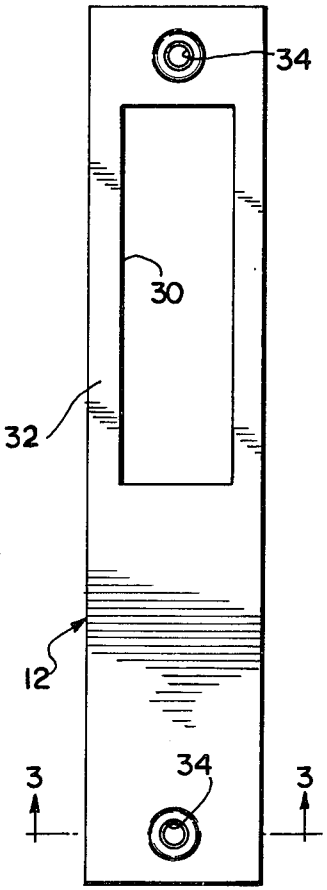
FIG. 2 is a front elevational view of the strike plate of FIG. 1.
Figure 3:
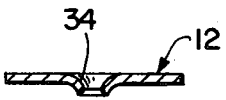
FIG. 3 is a sectional view of the strike plate along lines 3—3 of FIG. 2.

Strike plate 12, as illustrated in FIGS. 1–3, comprises a rectangular, planar plate which is sized and shaped to be received in the door frame recess and overlie mounting flange 22. An elongated, rectangular aperture 30 extends through plate 12 and is longitudinally offset toward one end of the strike plate. Aperture 30 has a length approximately equal to one-half the length of the strike plate and is completely surrounded by the plate. By forming aperture 30 in this manner, the plate is provided with portions 32 laterally adjacent aperture 30. Countersunk mounting holes 34 are formed adjacent each longitudinal end of strike plate 12 and are spaced apart by a distance equal to the spacing between mounting holes 28 in the door frame. The strike plate is mounted to the door frame by mounting screws 36 which pass through and are secured in the respective holes 28,34.

Typically, strike plate 12 is formed of 16 gauge c.r. steel, is 5.625 inches long, 1.125 inches wide, and 0.060 inch thick. Mounting holes 34 are countersunk for 8/32 flat head screws and are spaced 0.315 inch from each longitudinal end of the plate. Aperture 30 is 2.438 inches long, 0.8675 inches wide, and is spaced 0.625 inches from the closest longitudinal end of the plate. The mounting holes and the aperture are aligned along the longitudinal center line of the plate.

Figure 4:
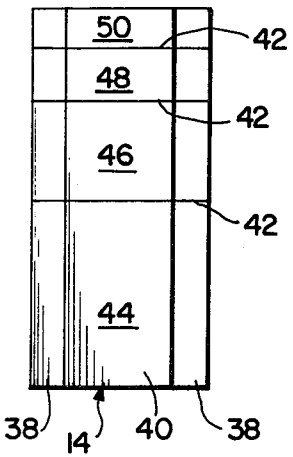
FIG. 4 is a front elevational view of the cover plate of FIG. 1.
Figure 5:
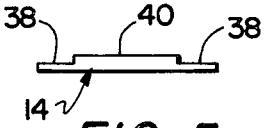
FIG. 5 is an end elevational view of the cover plate of FIG. 4.

Cover plate 14, as illustrated in FIGS. 1, 4 and 5, comprises a rectangular member with lateral flanges 38 extending along opposite lateral edges of plate 14 and a central thicker portion forming a protrusion 40 extending parallel to and between the flanges. The flanges and protrusion provide relatively thin sections adjacent the lateral sides of the cover plate and a relatively thick portion in the center thereof. Flanges 38 are shaped to be received in the recess for door frame flange 22 such that the cover plate is mounted to the door frame in frictional engagement between strike plate 12 and mounting flange 22. Protrusion 40 extends into strike plate aperture 30 to provide a substantially flush finish on the covered portions of aperture 30. The cover plate is also provided with weakened zones 42 along lines extending transversely across cover plate 12 to define a plurality of separable cover portions 44,46, 48,50. Any combination of the cover plate portions can be mounted between strike plate 12 and the door frame to close off the desired portions of opening 26 and aperture 30.

Typically, cover plate 14 is molded of plastic such as acrylonitrile-butadiene-styrene (ABS) or polyvinylchloride (PVC) having an overall length of 2.422 inches and an overall width of 1.125 inches. The central protrusion is 0.672 inch wide and 0.080 inch thick, while flanges 27 are each 0.227 inch wide and 0.025 inch thick.

Figures 6, 7A, 7B, 7C, 7D, 7E:
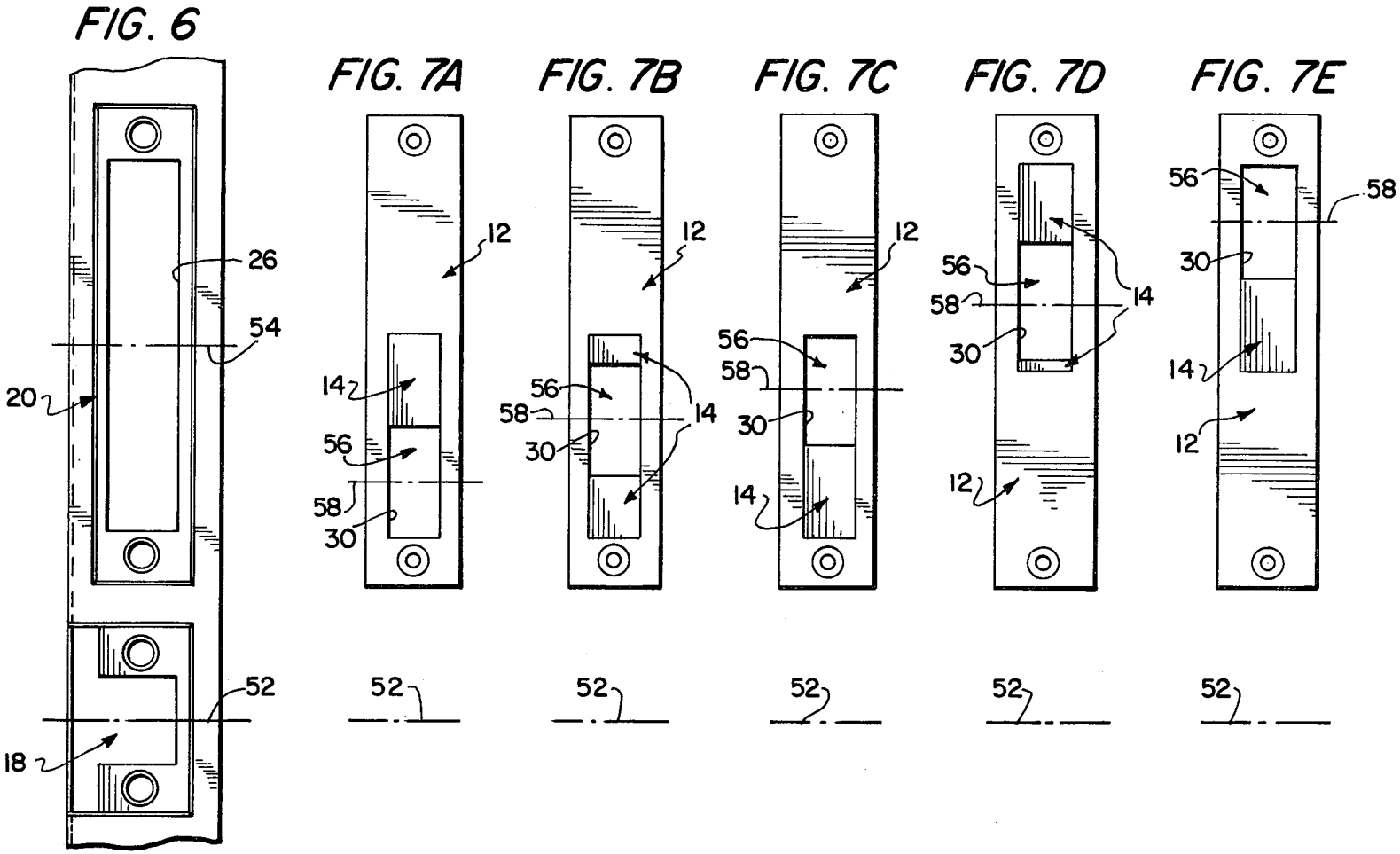
FIG. 6 is a partial, front elevational view of a door frame prior to installation of the adapter assembly of the present invention.
FIG. 7A to 7E are front elevational views of the adapter assembly of FIG. 1 illustrating different positions of the strike plate and cover plate in accordance with the present invention.

A variety of different configurations of adapter assembly 10 are illustrated and are discussed with reference to FIGS. 6 and 7A–7E. FIG. 6 illustrates a door frame with knobset lock bolt preparation 18 and deadbolt preparation 20, but without the adapter assembly. Knobset preparation 18 is mounted with a center line 52 located at a predetermined position above the door frame threshold. Center line 54 of opening 26 is located at a fixed distance above center line 52. The spacing of center lines 52 and 54, and the length of opening 26 are chosen to accommodate a wide variety of lock styles and spacing.

There are basically two steps in adjusting adapter assembly 10 for a particular lock arrangement. The first step involves orienting strike plate 12 in one of two relatively inverted positions, i.e., with aperture 30 located in a lower position as illustrated in FIGS. 7A, 7B and 7C, or in an upper position as illustrated in FIGS. 7D and 7E.

The second step involves selection of the cover plate portion or portions to be used and positioning such portion or portions within strike plate aperture 30. Five different arrangements of the adapter assembly are illustrated in FIGS. 7A–7E. In each of the FIGS. 7A through 7E, a space 56 is formed by the portion of strike plate aperture 30 not covered by cover plate 14. Space 56, in each of these figures, has a center line 58 located at a different distance from the knobset preparation center line 52 by locating the strike plate in one of its two inverted positions and by selecting and variously locating the appropriate cover plate portions within aperture 30.

In this manner, a space can be formed in door frame 16 simply and easily which is properly located and properly sized, thereby customizing the door frame to the particular deadbolt lock arrangement employed in the door. The adapter assembly 10 can be installed using only a screwdriver for screws 36, and a measuring device for positioning strike plate 12 and for selecting and locating the cover plate portions. No additional tools are required since no cutting operations need be performed by the installer. Moreover, the adapter assembly of the present invention can be assembled and disassembled readily so as to permit a trial and error method of construction and a change in the lock assembly.

While one advantageous embodiment has been chosen to illustrate the invention, it will be understood by those skilled in the art that various changes and modifications can be made therein without departing from the scope of the invention as defined in the appended claims.

What is claimed is:

1. An adapter assembly for use in combination with a door frame of the type having a vertically elongated opening to receive a bolt extending from a lock mounted in a door coupled to the frame, the adapter assembly comprising an elongated strike plate having an elongated, generally rectangular aperture therein, said aperture being longitudinally offset toward one longitudinal end of said strike plate and completely surrounded by said strike plate;

mounting means, located adjacent longitudinal ends of said strike plate, for coupling said strike plate to the frame such that said strike plate overlies the elongated opening selectively in one of first and second positions, with said first position being inverted relative to said second position in a vertical direction about an axis perpendicular to the plane of said plate; and adjustable cover means, coupled to said strike plate, for closing at least a portion of said aperture and the opening, said cover means having flanges extending along opposite lateral side edges thereof adapted to underlie portions of said strike plate laterally adjacent said aperture.

2. An adapter assembly according to claim 1 wherein said aperture has a length approximately one-half that of said strike plate.

3. An adapter assembly according to claim 1 wherein said cover means has an elongated central protrusion extending parallel to and between said flanges.

4. An adapter assembly according to claim 1 wherein said cover means has a length substantially equal to that of said aperture.

5. An adapter assembly according to claim 1 wherein said cover means comprises an elongated cover plate having weakened zones along lines extending transversely across said cover plate, said lines defining a plurality of separable cover plate portions any combination of which can be coupled to said strike plate at various locations along said aperture.

6. An adapter assembly according to claim 1 wherein said cover means has a length substantially less than that of said aperture and can be coupled to said strike plate at various locations along said aperture.

7. An adapter assembly for mounting on a door frame having an elongated rectangular opening to receive a bolt extending from a lock mounted in a door coupled to the frame, the adapter assembly comprising an elongated, rectangular strike plate having an elongated, rectangular aperture therein, said aperture being longitudinally offset toward one end of said strike plate and being completely surrounded by said strike plate;

mounting means for coupling said strike plate to the frame such that said strike plate overlies the elongated opening selectively in one of first and second positions, with said first position being inverted relative to said second position; and an elongated cover plate having flanges extending along opposite lateral side edges thereof to underlie portions of said strike plate adjacent said aperture, an elongated central protrusion extending parallel to and between said flanges adapted to extend through said aperture, and weakened zones along lines extending transversely across said cover plate, said lines defining a plurality of separable cover plate portions any combination of which can be coupled to said strike plate at various locations along said aperture.

8. An adapter assembly according to claim 7 wherein said mounting means is located adjacent longitudinal ends of said strike plate.

9. An adapter assembly according to claim 7 wherein said first and second positions are inverted in a vertical direction to locate said aperture in one of two vertically spaced locations.

10. An adapter assembly according to claim 7 wherein said aperture has a length approximately one-half that of said strike plate.

* * * * *